United States Patent [19]

Roth et al.

[11] Patent Number: 4,503,990

[45] Date of Patent: Mar. 12, 1985

[54] DRAWN CAN FOR FOOD AND THE LIKE

[75] Inventors: Donals J. Roth, Westport; Charles S. Kubis, Weston, both of Conn.; John Walter, Evergreen Park, Ill.

[73] Assignee: Continental Packaging Company, Inc., Stamford, Conn.

[21] Appl. No.: 587,099

[22] Filed: Mar. 7, 1984

[51] Int. Cl.[3] ..... B65D 17/40

[52] U.S. Cl. ..... 220/276; 220/270; 220/66; 220/67; 220/75

[58] Field of Search ..... 220/270, 276, 75, 66, 220/67

[56] References Cited

U.S. PATENT DOCUMENTS

| | | | |
|---|---|---|---|
| 220,022 | 9/1879 | Green et al. | 220/276 |
| 3,465,910 | 9/1969 | Richie | 220/270 |
| 4,103,802 | 8/1978 | Piltz et al. | 220/270 |
| 4,212,409 | 7/1980 | Jeppson | 220/276 |

*Primary Examiner*—George T. Hall

*Attorney, Agent, or Firm*—Charles E. Brown

[57] ABSTRACT

This relates to a can, preferrably formed of aluminum, which may be formed by a drawing process and which is so constructed wherein it may utilize wall thicknesses less than those which are presently commercially permissible so as to be suitable for the packaging of food products and the like which are either hot filled or subject to retorting and still commercially compete with three-piece steel cans. A primary feature of the can is the elimination of the customary double seam securing the end unit to the can body and replacing the same with telescoping of portions of the can body and end unit and providing an adhesive bond therebetween with the adhesive bond being enhanced by the reaction of the can body and end unit under conditions of internal pressure and internal vacuum due to the radial compression of the adhesive forming the adhesive bond to increase the shear strength of the adhesive. The end unit is provided with a securing flange which is connected to the end panel by a corner defining a line of weakness wherein the securing flange may be torn from the end panel and at the same time peeled from the can body.

19 Claims, 7 Drawing Figures

DRAWN CAN FOR FOOD AND THE LIKE

This invention relates in general to new and useful improvements in containers, and more particularly to containers of the type generally identified as cans and wherein the can body is provided with an integral bottom.

In the past great efforts have been made to form can bodies, particularly of aluminum, with an integral bottom by a drawing operation. Such can bodies are formed either by a draw-redraw (DRD) operation or by a draw wall ironing (DWI) operation. Cans so constructed are made with thinner side walls and bottoms and, where high internal pressures are involved, such as in soft drink and beer cans, such drawn aluminum cans in particular have proved to be more economically feasible.

On the other hand, it has not been economically feasible to form food cans and the like of aluminum as opposed to the known three-piece steel can or the DRD steel can because aluminum does not have the structural strength/cost relationship of steel. Although there are patents which describe aluminum cans formed of varying thicknesses, for commercial purposes the specific Alcoa DRD aluminum can calls for 9 mil side wall and bottom and 11 ml for the customer end. These wall thicknesses are presently required with respect to cans which are hot filled or subjected to a retort.

This invention particularly relates to a commercially feasible aluminum can for food and like products which is to be either hot filled or retorted.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
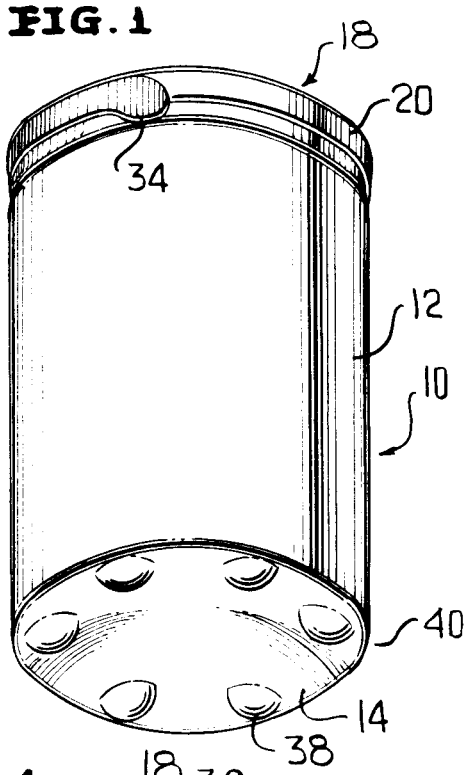
FIG. 1 is a bottom perspective view of a can formed in accordance with this invention.
Figure 2:
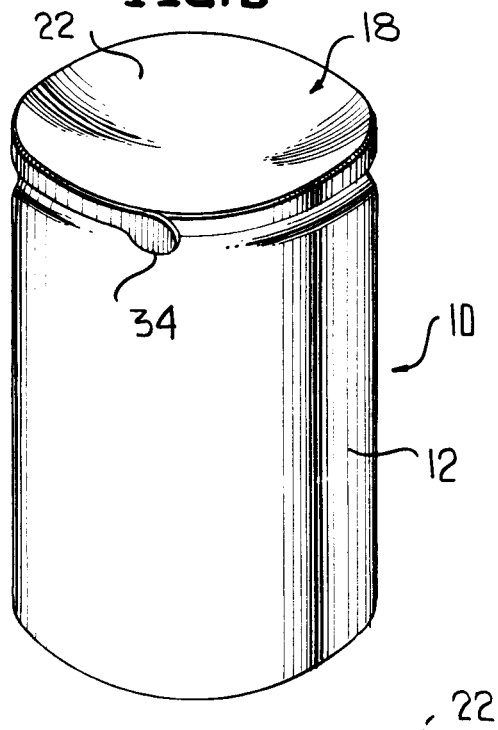
FIG. 2 is a top perspective view of the can of FIG. 1, and shows the details of the customer end unit.

Referring now to the drawings in detail, it will be seen that there is illustrated in FIGS. 1 and 2 a can formed in accordance with this invention, the can being generally identified by the numeral 10. The can 10 includes a can body 12 which is formed with an integral bottom 14. The bottom 14 will be more specifically described hereinafter.

It is to be understood that the can body 12 and the integral bottom 14 will be formed by a drawing operation which may be either of the DRD type of of the DWI type.

Figure 3:
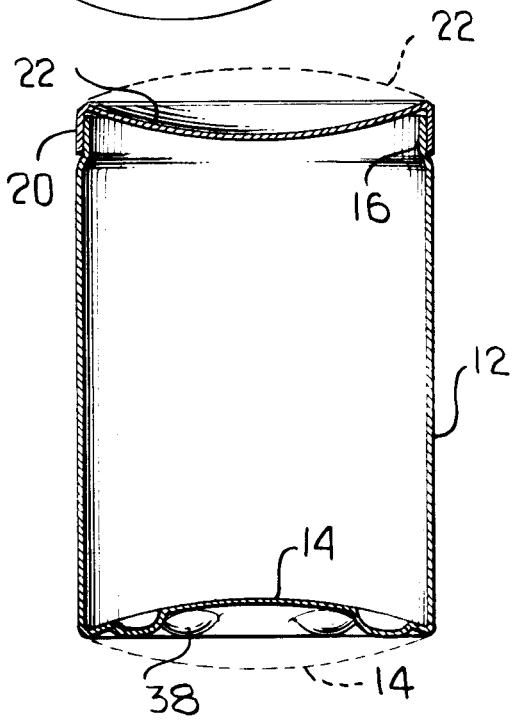
FIG. 3 is an enlarged vertical sectional view taken generally along the line 3—3 of FIG. 1.

The can body 12, as is best shown in FIG. 3, is provided with an open mouth which is defined by a necked-in free end portion 16. The open mouth is closed by an end unit, generally identified by the numeral 18, which is referred to as the customer's end unit in that it is applied by the packer after the product has been placed within the can.

The end unit 18 includes a tubular securing flange 20 and an end panel 22 which are connected together by a corner construction generally identified by the numeral 24. The tubular securing flange 20 is telescoped over the necked-in free end portion 16 of the can body 12 and is secured thereto by an adhesive bond 26 including a layer of adhesive 28. The adhesive 28 may vary, but it is preferably one which has its shear strength increased when it is compressed, and while it has a high shear strength, it does not unduly resist peeling.

Inasmuch as the end unit 18 is secured to the body 12 by an adhesive bond as opposed to a conventional double seam, the thickness of the end unit and the can body and its bottom can be reduced. It has been found possible to reduce the thickness of the can body wall and the bottom to no greater than 8 and possibly 7 mil. Further, the end unit wall thickness can be reduced to at least 9 mil and as low as 7 mil.

Referring once again specifically to the end unit 18, this end unit is preferably utilized in conjunction with food products and the like which are to be subjected to retorting. Accordingly, the end panel 22 is axially inwardly bowed so as to present a concave configuration. The thickness or thinness of the end panel 22 is such that when the product packaged within the can 10 is heated, and particularly when the gases or liquids therein expand, the end panel 22 may evert or pop out to assume the dotted line position of FIG. 3. Then, as the product cools and the gases contract or condense, the vacuum which is thus produced within the can 10 will effect a reverse movement of the can end 22 back to its original position.

Since there is no double seam connecting the end unit 18 to the can body 12, the usual shoulder with which a can opener is engaged does not exist, and the can 10 cannot be opened by a conventional can opener. Accordingly, the end unit 18 is of the easy opening type requiring no tool. The end panel 22 is connected to the tubular securing flange 20 by the corner 24 which is of a special construction. The corner 24 is in part defined in a forming operation wherein the interior surface of the corner 24 is rounded as at 30 in the customary manner. On the other hand, the outer surface of the corner 24 is essentially flat as at 32. The cross section of the connecting corner 24 is effected by what is normally known as a pinch scoring operation. The flattening of the corner is controlled, and this results in a controlled reduction in thickness of the central part of the corner so as to define a weakening line or an area of weakness.

As is clearly shown in FIGS. 1 and 2, the tubular securing flange 20 is provided with an integral pull tab 34. When it is desired to open the can 10, the pull tab 34 is lifted and pulled circumferentially with the result that the securing flange 20 is ruptured transversely of its periphery, preferably along a weakening line (not shown), and then the material forming the corner 24 is torn along the line of weakness. Inasmuch as the adhesive 28 has relatively low peel strength, the securing flange 20 may be peeled from the necked-in free end portion 16 of the can body 12. When the securing flange 20 is totally torn from the end panel 22, it is also separated from the can body 12.

Figure 5:
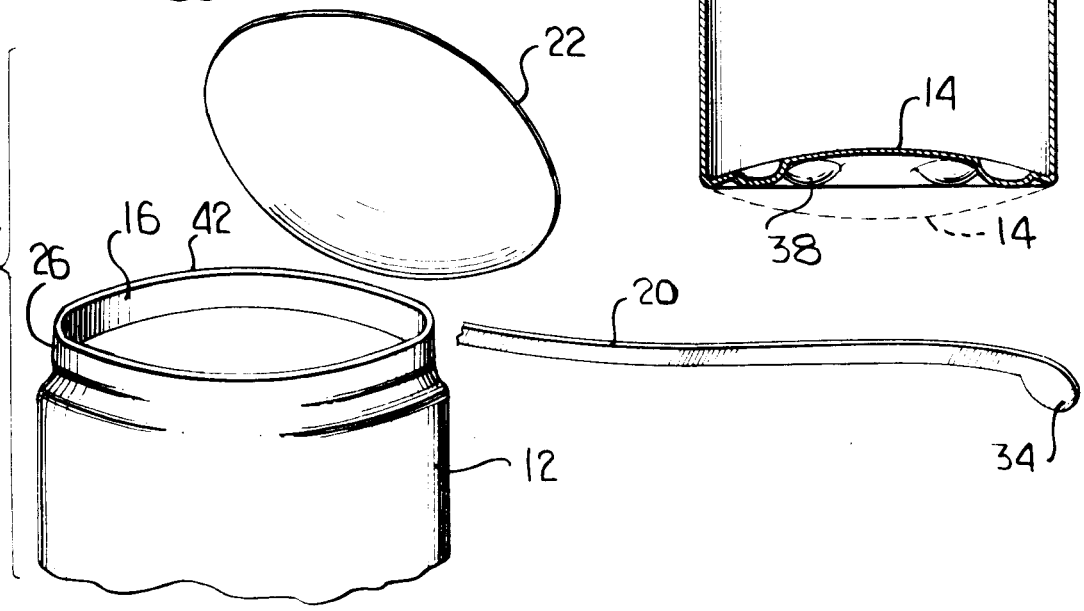
FIG. 5 is a fragmentary exploded perspective view showing the can of FIG. 1 in its opened state.

Because the metal of the end unit 18 is relatively thick and preferably formed of aluminum, it has been found that although a raw edge exists around the end panel 22 and along one edge of the securing flange 20, as is clearly shown in FIG. 5 the resultant raw edge is not sufficiently sharp to cause injury.

The specific configuration of the end unit 18 and its connection to the can body 12 has a further advantage. As has already been developed by us, it has been found that when the end panel 22 assumes a dome configuration as occurs when it everts in the manner shown in FIG. 3, there is a beaming action between the end panel 22 and the securing flange 20 which causes at least that part of the flange 20 adjacent the corner 24 to be drawn radially inwardly, and thus place the adhesive 28 under compression. This not only makes the bond more secure, but in the case of certain adhesives, increases the shear strength of the adhesive.

At this time it is also pointed out that when the can 10 is under internal pressure, tending to separate the end unit 18 from the can body 12, there is also a tendency to straighten out the necked-in portion 16 which results in a compressive force being applied on the adhesive 28 in a radially outward direction remote from the corner 24. Thus the combined beaming action and the straightening force places the adhesive totally in compression and thereby increases the shear strength thereof.

Although the end unit 18 is primarily intended for use in conjunction with products which are to be retorted, when the end unit 18 is utilized in conjunction with a hot fill product, should a vacuum exist within the can 10, that vacuum will draw the end panel 22 downwardly to hold the end unit 18 in place. Further, the end panel 22 will draw the corner 24 radially inwardly and exert a radially inwardly directed force on the securing flange 20 so as to effect a compressing of the adhesive 28, thus enhancing the connection between the end unit 18 and the can body 12.

At this time it is pointed out that the securing flange 20 may have a radially outwardly turned free edge portion 36 which will facilitate the telescoping of the necked-in free end portion 16 within the securing flange 20.

It is also pointed out here that the free end portion 16 will be necked-in a radial distance equal to the combined thickness of the adhesive 26 and the securing flange 20 so that the securing flange 20 will be of an exterior diameter substantially the same as that of the exterior of the can body 12.

The can body 12, when made of a thickness on the order of from 7 to 8 mil, will also evert under pressure. Accordingly, it is preferred that the bottom 14 be also axially inwardly bowed so as to be of a concave configuration. The bottom 14 is preferably provided with axially outwardly projecting dimples 38 which may be six or more in number and which will be uniformly circumferentially spaced. The dimples 38 will be disposed within the confines of a lower corner 40 of a can body 12 so as not to interfere with the seating of the can 10 on a supporting surface. However, when the bottom 14 everts, as shown in dotted lines, the dimples 38 will project down below the bottom and form supports for the can.

It is understood that while the bottom 14 will axially outwardly bow when the can is subjected to internal pressurization as would occur due to retorting, when the product, liquid and gases cool, the resultant vacuum also results in the return of the bottom 14 to its original position. Thus, the corner 40 must provide a hinging action on the bottom 14.

Figure 4:
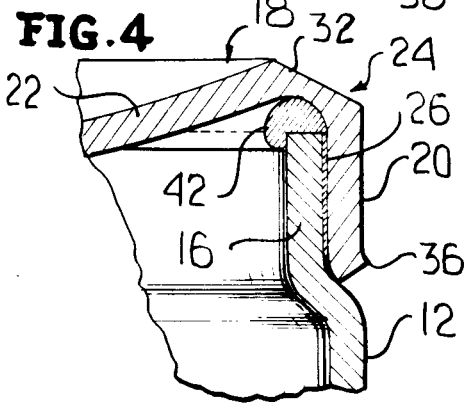
FIG. 4 is an enlarged sectional view of the end unit corner and the bond between the end unit and the can body.

It is to be understood that there has already been developed automatic machinery which will receive the one-piece can body and bottom 14 having a suitable product placed therein and which will apply the end unit 18. It is to be understood that the end unit 18 will have the adhesive 28 applied thereto, the adhesive being preferably a hot melt adhesive, and that the end unit 18 will be applied to the can body 12 while the adhesive is still flowable. It will also be understood that the adhesive will be reheated to be fully flowable, after which the end unit 18 will be pressed into its final position on the can body 12. The net result is that a certain amount of the adhesive 28 will be formed as a bead 42 overlying and protecting the free raw edge of the necked-in portion 16, as shown in FIG. 4.

Referring now to FIG. 5, it will be seen that after the end unit 18 has been removed from the can body, the end unit will normally be in two separate pieces, one piece being primarily in the form of the end panel 22 and the other primarily being in the form of the securing flange 20. It is, however, feasible in the formation of the end unit 18, to discontinue the pinch score at a point adjacent the pull tab 34 so that the end panel 22 does not fully separate from the securing flange 20.

Figure 7:
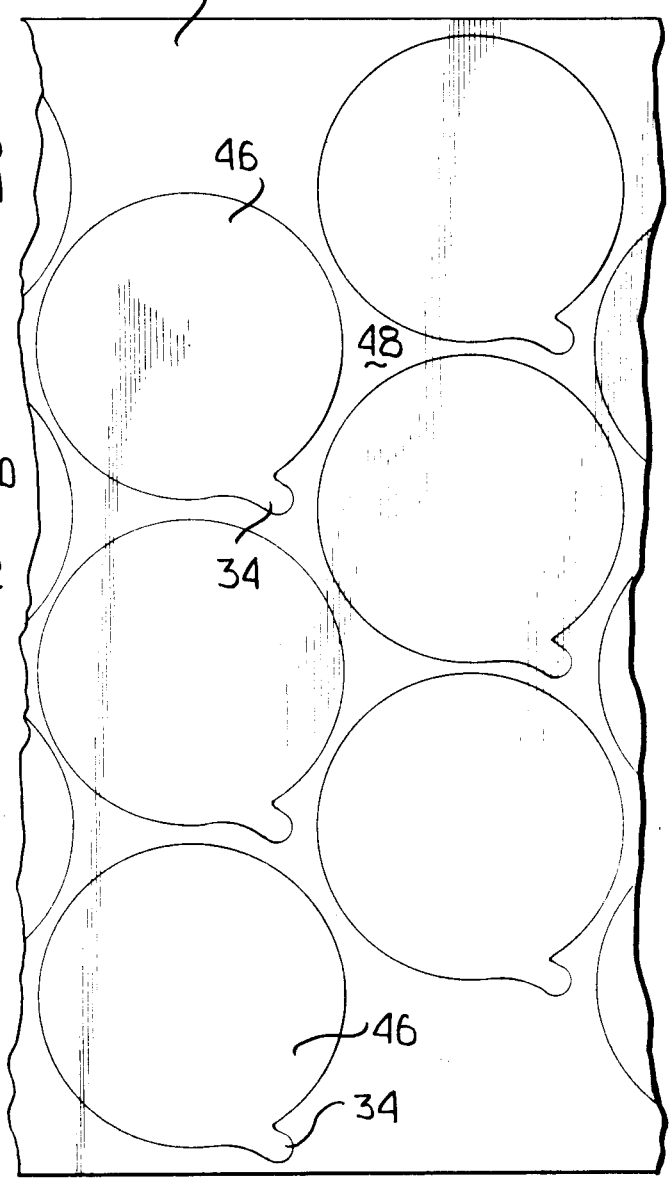
FIG. 7 is a fragmentary plan view showing the manner in which end unit blanks may be formed from strip material without requiring extra material for a pull tab.

Reference is now made to FIG. 7 wherein it is shown that end units, such as the end unit 18, may be formed with the integral pull tab 34 without requiring extra material in the formation of such end units. End units, particularly those formed of aluminum, are formed from a strip 44 with there being defined in the strip 44 blanks 46 which are circular in outline. As opposed to the blanks 46 being in substantially touching relation to an adjacent blank, it is preferred, in an operation which is not part of this invention, to retain the blanks 46 as part of the strip 44 during the formation of the end units 22 to their final shape. Thus, there are areas 48 between adjacent nested blanks 46 from which the pull tab 34 may be formed without waste.

It is pointed out here that even if the blanks 46 were punched from the strip 44 prior to shaping or forming, there is always material between the nested blanks sufficient for the formation of a pull tab. Thus, the provision of the pull tab 34 does not increase the cost of the end units 18.

Figure 6:
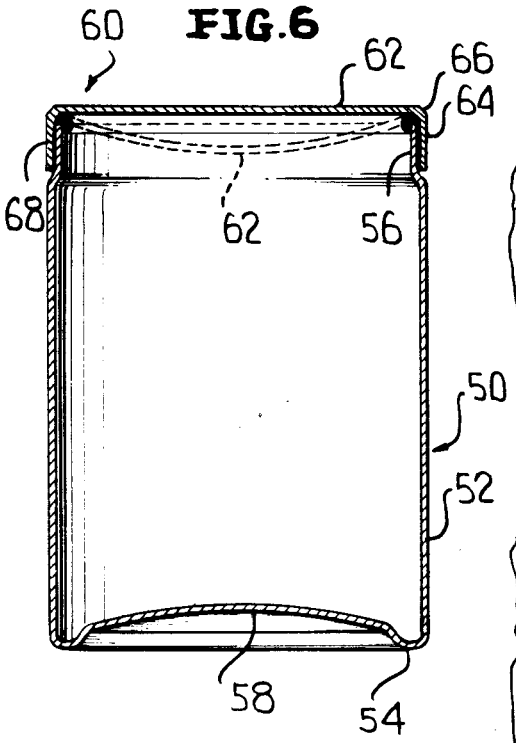
FIG. 6 is an enlarged vertical sectional view similar to FIG. 3, and shows a modified can.

Reference is now made to the modified can shown in FIG. 6. This can differs from the can 10 and is identified by the numeral 50. While the can 50 is of a two-piece construction and the body 52 is identical to the body 12, including the necked-in end portion 56, it is particularly adapted for receiving products which are hot filled. In lieu of being formed with a bottom 54 which everts, the bottom should be formed with an integral reinforcement 58.

It will be seen that the end unit, generally identified by the numeral 60, differs from the end unit 18 in that in lieu of having an end panel 62 which is axially inwardly bowed or concave, the end panel 62 may be substantially planar. The end unit 60 includes a tubular securing flange 64 which corresponds to the securing flange 20, and the securing flange 64 and end panel 62 are joined together by a connecting corner generally identified by the numeral 66. The connecting corner 66 will be of a weakened construction the same as the connecting corner 24 so that the can 50 may be opened by tearing the securing flange 64 from the end panel 62. The securing flange 64 will be telescoped over and secured to the necked-in free end portion 56 of the can body 52 utilizing an adhesive bond 68 which will be identical to the adhesive bond 26.

It is to be understood that when the can 50 is closed while containing a product which has been placed into the can while hot, after the product cools down a vacuum will occur within the can with the result that the end panel 62 will evert and assume the concave shape as shown by dotted lines. The assumption of this concave shape will result in the connecting corners 66 being drawn radially inwardly with a resultant drawing of the securing flange 64 radially inwardly to compress the adhesive of the adhesive bond 68.

It is to be understood that the higher metal cost of aluminum as opposed to steel is partially offset by lower organic material cost, i.e. inside lacquer and outside varnish, and that this, combined with the ability to commercially utilize thinner wall thicknesses throughout, will permit the above described cans to complete economically with present day three-piece steel cans.

Although only two preferred embodiments of the cans have been specifically illustrated and described herein, it is to be understood that minor variations may be made in the cans without departing from the spirit and scope of the invention as defined by the appended claims.

We claim:

1. An end unit for a container subject to retorting and like different heat conditions, said end unit comprising a tubular securing flange, an end panel, and a connecting corner, said connecting corner defining a weakening line for facilitating the removal of said tubular securing flange from said end panel at said connecting corner.

2. An end unit according to claim 1 wherein an integral pull tab projects from a free edge of said securing flange.

3. An end unit according to claim 1 wherein said end panel is axially inwardly concave and free to evert to an axially outwardly convex state.

4. An end unit according to claim 1 wherein said end panel is axially inwardly concave and free to evert to an axially outwardly convex state, and said weakening line defines a hinge line for said end panel.

5. An end unit according to claim 1 wherein said weakening line is defined by a pinch score.

6. An end unit according to claim 1 wherein said weakening line is defined by a pinch score, said connecting corner having a rounded concave inner surface and a flat diagonal outer surface with the material of said corner being the thinnest at the central portion thereof.

7. An end unit according to claim 1 wherein said end panel is initially substantially planar and is free to flex out of its plane.

8. A can for food and the like products, said can being subject to heating wherein a product within said can is selectively hot filled or heated as in a retort with an accompanying temporary expansion of product, liquid and gas to vary the internal pressure of said can, said can having a tubular body defining an open mouth, an end unit closing said open mouth, said end unit including a tubular securing flange telescoped over and having an adhesive bond with a free end portion of said tubular body, an end panel, and a connecting corner, said connecting corner defining a weakening line for facilitating removal of said unit from said can body by removal of said tubular securing flange from said end panel, and said adhesive bond being peelable to release said securing flange from said can body as it is separated from said end panel.

9. A can in accordance with claim 8 wherein said can body free end portion extends substantially to said connecting corner and under conditions of internal vacuum and pressure said end panel exerts a radially inwardly directed force on said tubular securing flange which places the adhesive of said adhesive bond under compressive stress.

10. A can in accordance with claim 8 wherein said can body free end portion extends substantially to said connecting corner and under conditions of internal vacuum said tubular securing flange is drawn radially inwardly by said end panel and places the adhesive of said adhesive bond under compressive stress.

11. A can in accordance with claim 8 wherein said can body free end portion extends substantially to said connecting corner and under conditions of internal pressure said tubular securing flange is drawn radially inwardly by said end panel and places the adhesive of said adhesive bond under compressive stress.

12. A can in accordance with claim 8 wherein said can body free end portion extends substantially to said connecting corner and under conditions of internal pressure said tubular securing flange is drawn radially inwardly by said end panel and places the adhesive of said adhesive bond under compressive stress, the resultant axially outward bowing of said end panel producing a beaming action on said tubular securing flange.

13. A can according to claim 8 wherein said end unit has a maximum thickness of 9 mil wherein torn edges of said end panel and said securing flange resulting from opening of said can would be free of raw edges of the type which normally result in the cutting of a person.

14. A can according to claim 8 wherein said can is subject to heating after filling and wherein said end panel is initially axially inwardly deformed while being free to bow axially outwardly under the influence of internal pressure and then return when cooled and the internal pressure removed.

15. A can according to claim 8 wherein said end panel is initially substantially planar and when a product is hot-filled into said can and said end unit is applied as said product cools a vacuum is produced in said can and said end panel is drawn axially into the interior of said can body.

16. A can according to claim 8 wherein said can body has an integral bottom, said can body is formed by a draw-redraw process and has a wall and bottom thickness on the order of 7 and 8 mil.

17. A can according to claim 8 wherein said can body free end portion is necked-in and internal pressure within said can tending to axially elongate said can body also tend to straighten out said necked-in portion and apply a compressive force to the adhesive of said adhesive bond.

18. A can according to claim 8 wherein said can has a normally concave bottom with said bottom being of sufficient wall thinness to pop out to a convex supporting position under internal pressure and to return to its original position under internal vacuum conditions.

19. A can according to claim 8 wherein said adhesive remains attached to said tubular body with the adhesive including a bead overlying a free edge of said tubular body at said open mouth and forming a guard bead for said free edge.

* * * * *